US008002470B2

(12) United States Patent
Cheng

(10) Patent No.: US 8,002,470 B2
(45) Date of Patent: Aug. 23, 2011

(54) DRAWABLE TRACK ASSEMBLY

(75) Inventor: Chi-Tsun Cheng, Taipei County (TW)

(73) Assignee: LIF J.K. Corporation, New Taipei (TW)

( * ) Notice: Subject to any disclaimer, the term of this patent is extended or adjusted under 35 U.S.C. 154(b) by 485 days.

(21) Appl. No.: 12/194,543

(22) Filed: Aug. 20, 2008

(65) Prior Publication Data

US 2010/0046863 A1 Feb. 25, 2010

(51) Int. Cl.
*A47B 88/04* (2006.01)
*A47B 88/16* (2006.01)

(52) U.S. Cl. ..... 384/19; 384/17; 384/21; 312/334.12; 312/334.42; 312/334.44

(58) Field of Classification Search ..... 384/17–19, 384/21, 34; 312/257.7, 333, 34.7, 334.27, 312/334.46, 334.12, 334.42, 334.44; 248/222.1, 248/222.13; 361/725
See application file for complete search history.

(56) References Cited

U.S. PATENT DOCUMENTS

| | | | | | |
|---|---|---|---|---|---|
| 2,687,924 | A * | 8/1954 | Gomersall | 384/19 |
| 2,780,510 | A * | 2/1957 | Cole, Jr. | 312/334.13 |
| 2,864,656 | A * | 12/1958 | Yorinks | 384/19 |
| 3,092,429 | A * | 6/1963 | Barnes | 312/333 |
| 3,133,768 | A * | 5/1964 | Klakovich | 384/17 |
| 3,650,577 | A * | 3/1972 | Gutner | 384/21 |
| 3,801,166 | A * | 4/1974 | York | 384/18 |
| 4,387,942 | A * | 6/1983 | Lense | 384/19 |
| 5,262,923 | A * | 11/1993 | Batta et al. | 361/679.37 |
| 5,275,483 | A * | 1/1994 | Rasmussen | 312/334.41 |
| 5,433,516 | A * | 7/1995 | Beals et al. | 312/257.1 |
| 5,472,272 | A * | 12/1995 | Hoffman | 312/334.11 |
| 5,904,412 | A * | 5/1999 | Lammens | 312/334.7 |
| 6,201,690 | B1 * | 3/2001 | Moore et al. | 312/223.1 |
| 6,296,338 | B1 * | 10/2001 | Stijns | 312/333 |
| 6,305,739 | B1 * | 10/2001 | Corona | 296/165 |
| 6,373,695 | B1 * | 4/2002 | Cheng | 312/332.1 |
| 6,511,139 | B2 * | 1/2003 | Liu | 312/223.2 |
| 6,585,335 | B2 * | 7/2003 | Hwang et al. | 312/333 |
| 6,601,713 | B2 * | 8/2003 | Kaminski | 211/26 |
| 6,749,277 | B2 * | 6/2004 | Michaels | 312/334.5 |
| 6,854,816 | B2 * | 2/2005 | Milligan | 312/334.11 |
| 6,948,691 | B2 * | 9/2005 | Brock et al. | 248/222.13 |
| 6,988,626 | B2 * | 1/2006 | Varghese et al. | 312/334.4 |
| 7,008,030 | B2 * | 3/2006 | Yang | 312/334.46 |
| 7,150,509 | B2 * | 12/2006 | Chen et al. | 312/334.47 |
| 7,350,884 | B2 * | 4/2008 | Palker et al. | 312/334.1 |
| 7,604,307 | B2 * | 10/2009 | Greenwald et al. | 312/333 |
| 7,604,308 | B2 * | 10/2009 | Tseng et al. | 312/333 |
| 2004/0239220 | A1 * | 12/2004 | Yang | 312/334.44 |

* cited by examiner

*Primary Examiner* — Marcus Charles

(57) ABSTRACT

A drawable track assembly comprises a track and a retainer; the track being installed on a drawable box or other computer peripherals; the track having a plurality of locking points serving to be combined with a drawable box; the retainer is locked to a frame; and the retainer being installed with at least one rolling unit; thereby, a center of the retainer being formed with a sliding space at a central area thereof for receiving the track. Each of two sides of a long sheet of the track is extended with a strip for retaining a drawable box. A front end of the retainer is bent with a bending section with at least one through hole. The rolling unit is formed with a rolling post and a bearing set.

3 Claims, 5 Drawing Sheets

DRAWABLE TRACK ASSEMBLY

FIELD OF THE INVENTION

The present invention relates to tracks for retaining boxes, and in particular to a drawable track assembly which is a multi-sectional drawable track assembly for industrial computers.

BACKGROUND OF THE INVENTION

The prior tracks for industrial frame are not suitable for many new uses. Thus some novel structures are developed.

In one prior art, a seat of a track is installed with a roller groove which has received with a plurality of rollers. An outer side of each roller protrudes out to resist against an inner side of the seat. When the track is installed into the seat. The rollers are confined by the groove and slide therein so that the track is slideable along the seat. However the structure is complicated and the cost is high.

In another improvement, a pair of tracks are installed between a machine casing and a box array. The track is formed by a sliding unit and a track strip. An inner wall of the sliding unit is received into a stepped surface. An inner side of the stepped surfaces is installed with a long hole. The track strip is adhered to the stepped surfaces from an outer side of the sliding unit. The sliding unit is installed at an outer side of the casing so that the stepped surface and the lateral wall of the casing is formed with a trench. Then the track strip is retained to a box array. Thus the casing can be installed to the strip by using the sliding unit. The casing is slideable along the strip. Thus structure is easy and cost is low. However in using, it is found that the operation is not so smooth. A large force is necessary in operation.

SUMMARY OF THE INVENTION

Accordingly the object of the present invention it to provide a drawable track assembly, wherein each of an upper and a lower side of the track is fixed with at least one rolling unit and a central part of a retainer is formed with a sliding space for receiving the track so that a drawable box can be confined in a slideable position.

Moreover, the present invention can be used as a part of a multiple sliding track. A rear end of the whole track can be combined with another track so as to be formed as a multi-sectional tracks for positioning.

To achieve above object, the present invention provides a drawable track assembly comprising a track and a retainer; the track being installed on a drawable box or other computer peripherals; the track having a plurality of locking points serving to be combined with a drawable box; the retainer is locked to a frame; and the retainer being installed with at least one rolling unit; thereby, a center of the retainer being formed with a sliding space at a central area thereof for receiving the track. Each of two sides of a long sheet of the track being extended with a strip for retaining a drawable box. A front end of the retainer is bent with a bending section with at least one through hole. The rolling unit is formed with a rolling post and a bearing set.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
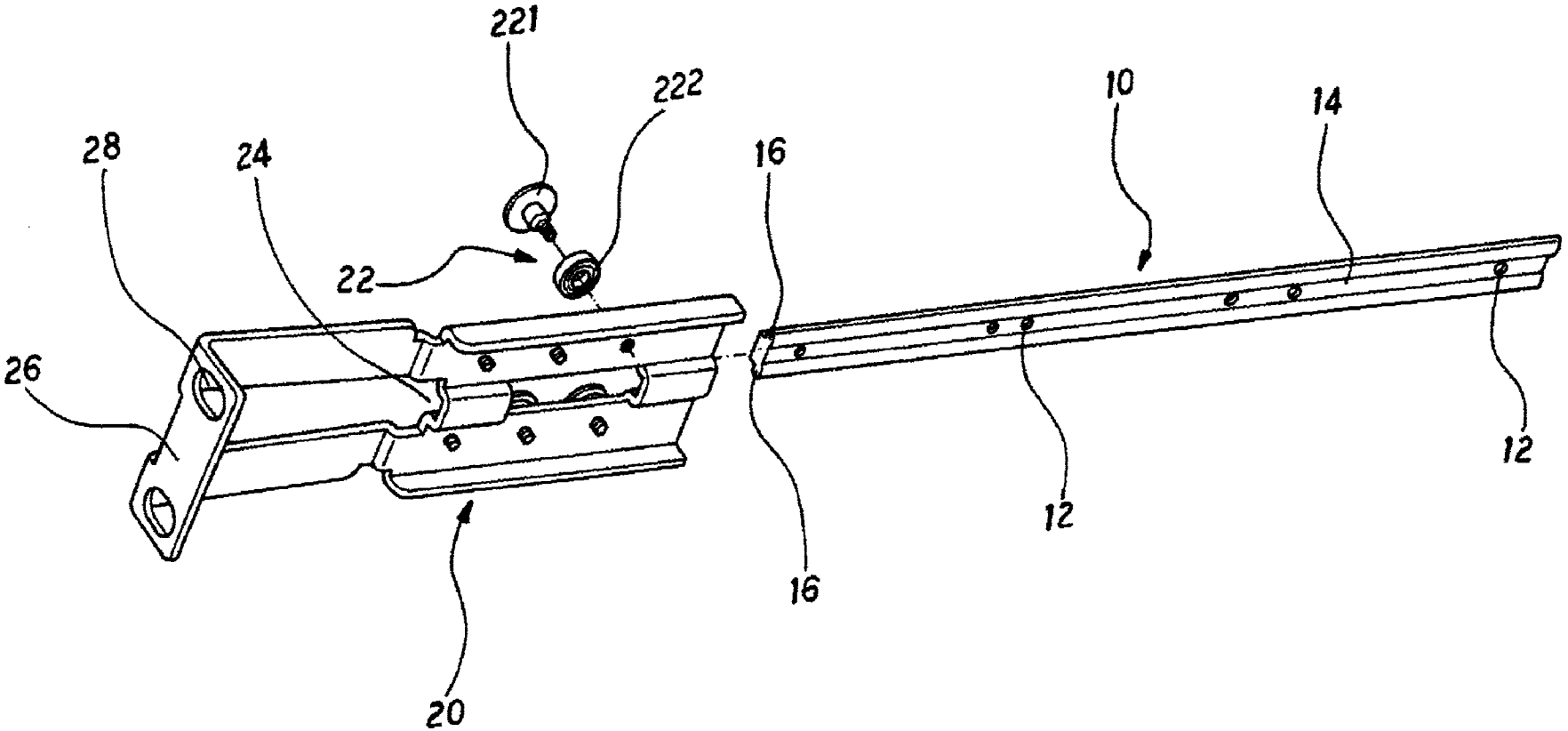
FIG. 1 is an exploded view of the drawable track assembly of the present invention.

With reference to FIG. 1, the present invention is installed on a drawable box and a frame thereof. Furthermore, the tracks are installed in parallel. The present invention has a track 10 and a retainer 20.

Figure 3:
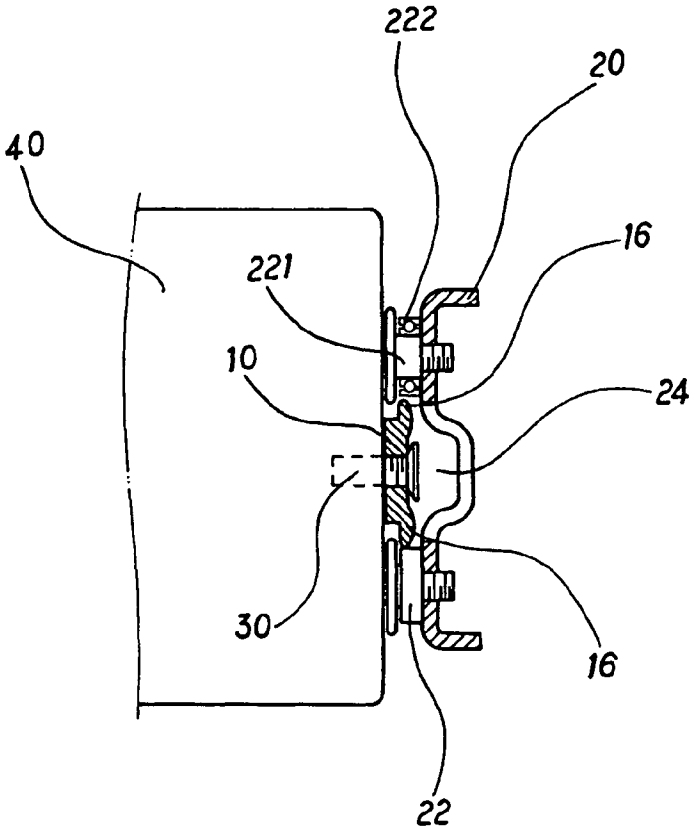
FIG. 3 is a cross sectional view along line 3-3 of the drawable track assembly in FIG. 2.

The track 10 is installed on a drawable box or other computer peripherals, such as a keyboard, a screen, etc. The track 10 has a plurality of locking points 12 serving to be combined with a drawable box. Each of two sides of a long sheet 14 of the track 10 is extended with a strip 16. The shapes of the track 10 and the strips 16 are illustrated in FIG. 3. The strip 16 causes that the rolling post 221 of the drawable box 40 slides thereon. The details will be described hereinafter. The retainer 20 is locked to a frame.

The retainer 20 is installed with at least one rolling unit 22. The rolling unit 22 is formed with a rolling post 221 and a bearing set 222. In this embodiment, three rolling units 22 are installed. Thereby, a center of the retainer 20 is formed with a sliding space 24 at a central area thereof for receiving the track 10. A front end of the retainer 20 is bent with a bending section 26 with at least one through hole 28.

Figure 2:
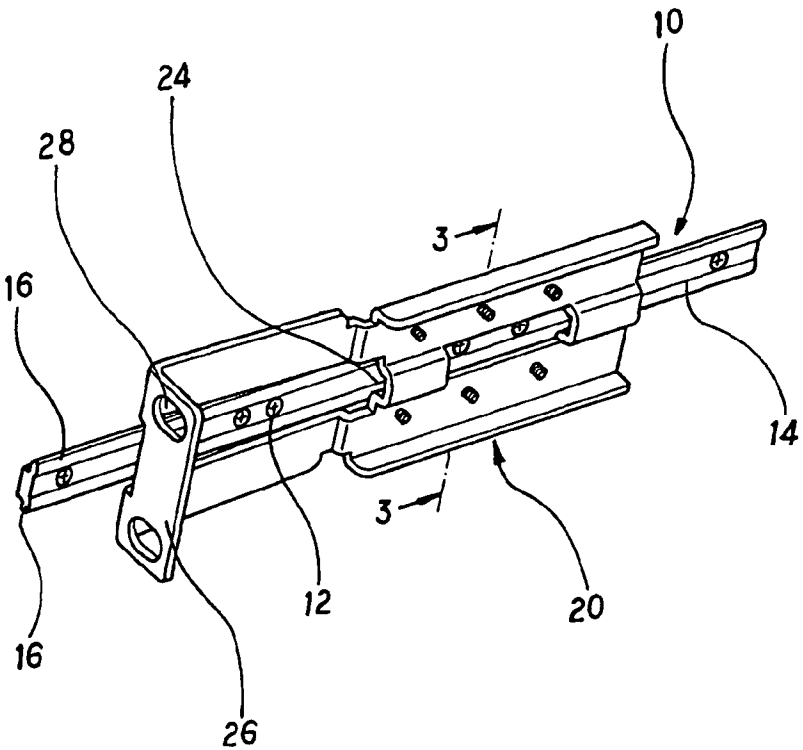
FIG. 2 is an assembled view of the drawable track assembly of the present invention.
Figure 4:
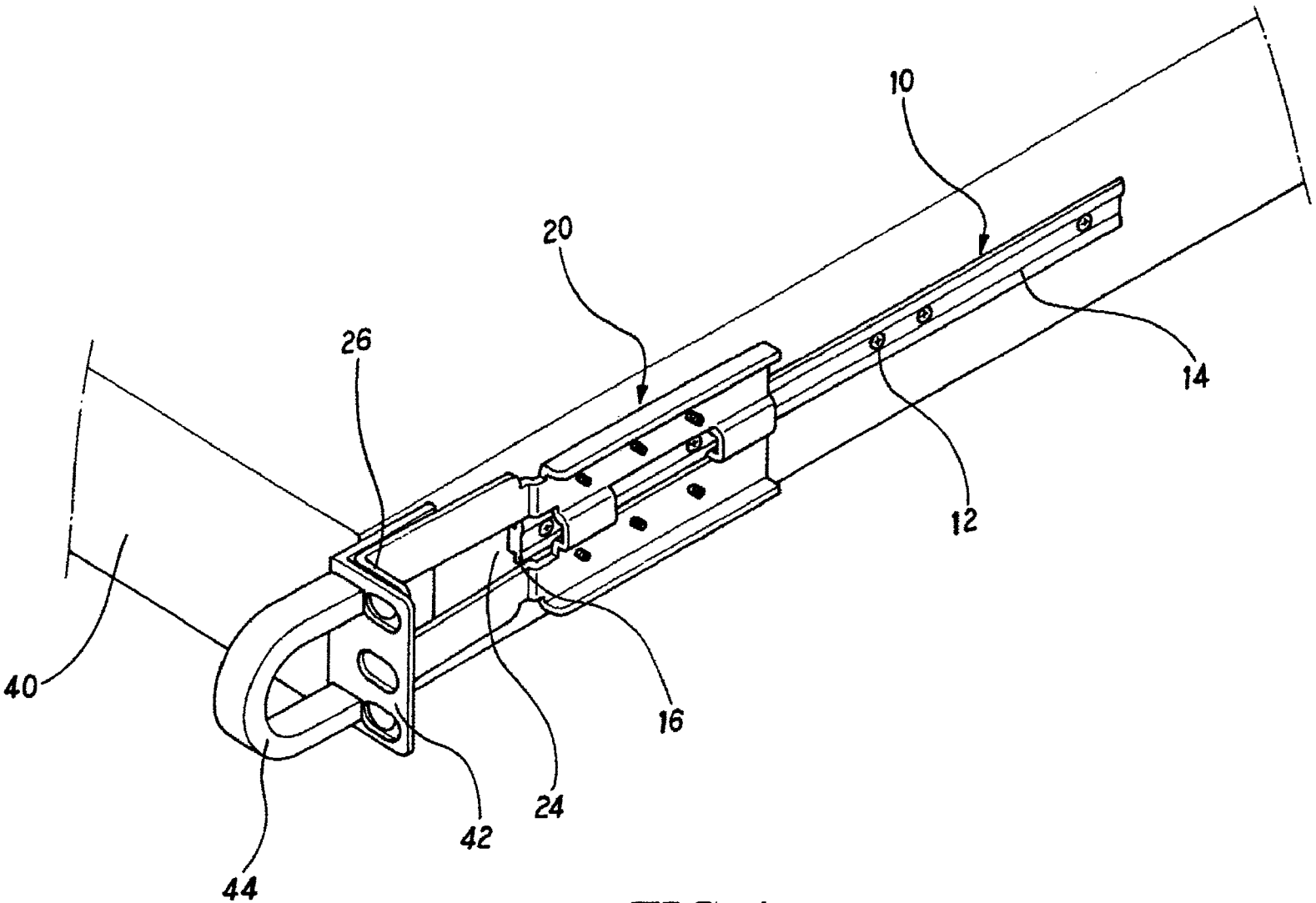
FIG. 4 shows the application of the present invention.

Referring to FIGS. 2 and 3, the track 10 is fixed to a lateral side of a drawable box 40 by using the locking points 12 and locking studs 30. Each side of the retainer 20 is installed with at least one rolling unit 22. The rolling post 221 can be inserted into the sliding space 24. The track 10 is slideable along the rolling units 22. Thus the drawable box 40 is slideable on the retainer 20 by using the track 10. With reference to FIG. 4, a front end of the drawable box 40 is connected and fixed with an L shape unit 42. A U ring 44 is installed to the L shape unit 42. The L shape unit 42 serves to stop the bending portion 26 of the retainer 20 so that the drawable box 40 will not fall into the frame by an over-large force.

Figure 5:
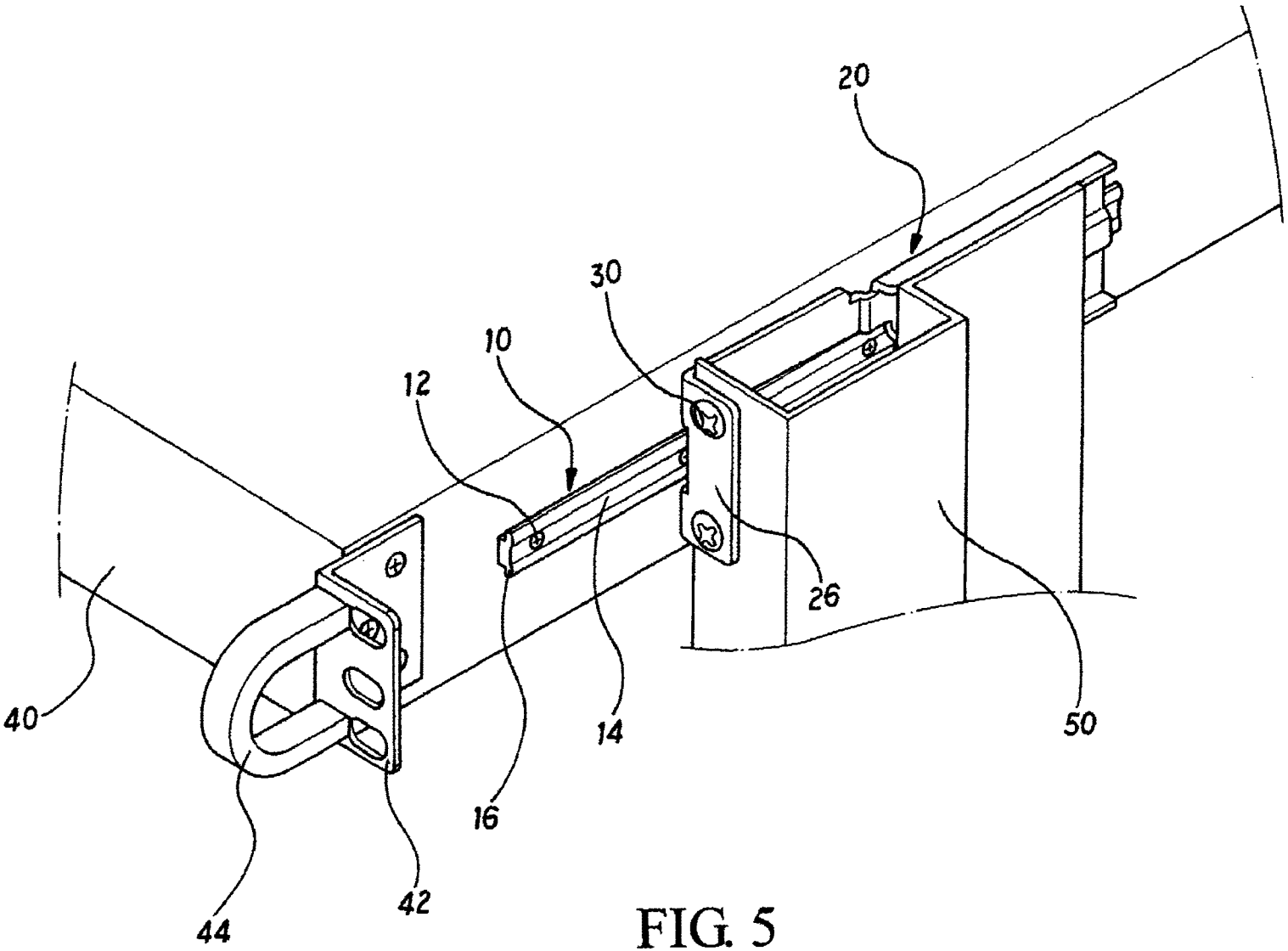
FIG. 5 shows another application of the present invention.

Referring to FIG. 5, the retainer 20 is combined with a frame 50. The bending portion 26 of the retainer 20 is locked to the frame 50 by using, for example, studs 30 or bucking. Therefore, the drawable box 40 is slideable along the track 10 retained to the retainer 20.

Figure 6:
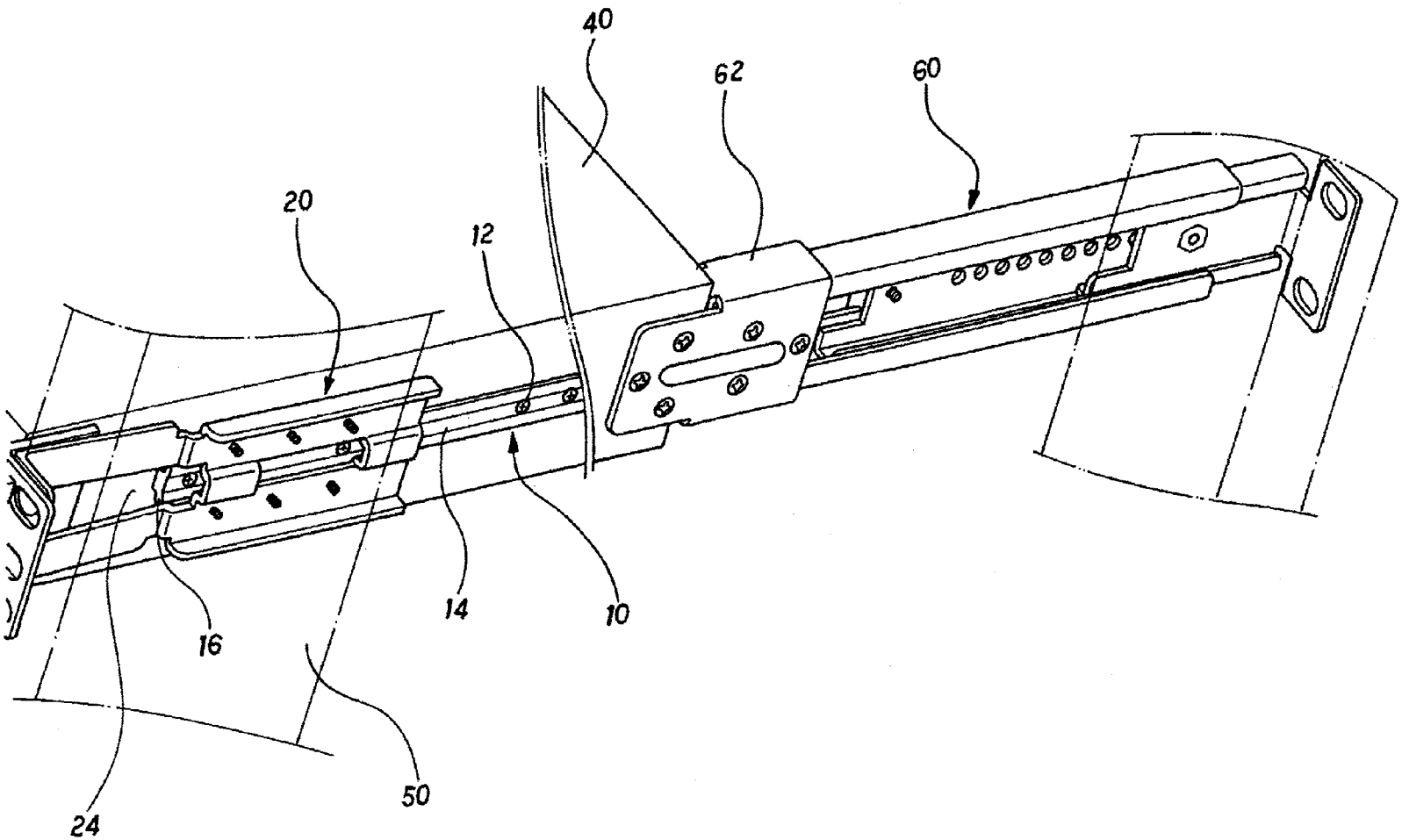
FIG. 6 is an assembled schematic view showing that the drawable box is combined to a track at a rear end thereof.

The present invention can be combined with other track seat. Referring to FIG. 6, a rear side of the drawable box 40 is retained to a front side 62 of another track set 60 so that the drawable box 40 can be slideable along another direction.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A drawable track assembly comprising:

a track, being installed on a drawable box or other computer peripherals, having a plurality of locking points serving to be combined with the drawable box, and having a T-shaped cross section; and a retainer, being installed with two rows of rolling wheels, each of the rolling wheels comprising a post and a bearing set ringing the post;

wherein a center of the retainer being formed with a longitudinal sliding space for receiving the track, and the track is clipped between the two rows of rolling units.

2. The drawable track assembly as claimed in claim 1, wherein each of two sides of a long sheet of the track is extended with a strip for retaining the drawable box.

3. The drawable track assembly as claimed in claim 1, wherein a front end of the retainer is bent with a bending section with at least one through hole.

* * * * *